US005842447A

United States Patent [19]

Krotky et al.

[11] Patent Number: 5,842,447

[45] Date of Patent: Dec. 1, 1998

[54] CYLINDER BLOCK OF AN INTERNAL-COMBUSTION ENGINE

[75] Inventors: Peter Krotky, Simmozheim; Guenter Helsper, Remseck; Markus Bauhofer; Antonius Rehr, both of Weissach, all of Germany

[73] Assignee: Dr. Ing. h.c.F. Porsche AG, Germany

[21] Appl. No.: 914,762

[22] Filed: Aug. 20, 1997

[30] Foreign Application Priority Data

Aug. 20, 1996 [DE] Germany ..... 196 33 419.5

[51] Int. Cl.[6] ..... F01P 1/04

[52] U.S. Cl. ..... 123/41.28; 123/41.74; 123/41.81; 123/195 R

[58] Field of Search ..... 123/195 R, 195 S, 123/41.28, 41.29, 41.42, 41.72, 41.73, 41.74, 41.81

[56] References Cited

FOREIGN PATENT DOCUMENTS

| | | |
|---|---|---|
| 0 110 406 A2 | 6/1984 | European Pat. Off. . |
| 0 137 328 A2 | 4/1985 | European Pat. Off. . |
| 0 376 900 A1 | 7/1990 | European Pat. Off. . |
| 0 628 716 A1 | 12/1994 | European Pat. Off. . |
| 2 060 056 | 4/1981 | United Kingdom . |
| 2 284 858 | 6/1995 | United Kingdom . |

OTHER PUBLICATIONS

The Porsche Engine 944 S2; P. Hensler, et al.; MTZ 50(Jan. 1989), pp. 151–157.

*Primary Examiner*—David A. Okonsky
*Attorney, Agent, or Firm*—Evenson, McKeown, Edwards & Lenahan, P.L.L.C.

[57] ABSTRACT

A cylinder block of an internal-combustion engine of an open-deck construction, in which the cooling water jacket and the oil jacket between the cylinder tube and the cylinder block housing are separated from one another by a connection web which connects the respective cylinder tubes with the cylinder block housing. In order to reduce the cylinder tube distortions in the braced condition of the cylinder block, ribs are provided at least in the water jacket or in the oil jacket. The ribs start out from the connection web and improve the linking of the cylinder tubes to the cylinder block housing. The height of these ribs is much lower than the height of the water jacket or of the oil jacket which results in a low weight increase and minimizes the linking lengths to the cylinder tube.

22 Claims, 3 Drawing Sheets

CYLINDER BLOCK OF AN INTERNAL-COMBUSTION ENGINE

BACKGROUND AND SUMMARY OF THE INVENTION

This application claims the priority of 196 33 419.5, the disclosure of which is expressly incorporated by reference herein.

The present invention relates to a cylinder block of an internal-combustion engine of an open-deck construction, and more particularly to a cylinder block having at least a cylinder tube, a cylinder block housing, a cooling water jacket and an oil jacket between the cylinder tube and the cylinder block housing and having a surrounding connection web between the cylinder tube and the cylinder block housing which separates the oil jacket and the cooling water jacket.

In the journal *MTZ Motor Technische Zeitschrift* 50 (1989), pp. 151–157, an internal-combustion engine cylinder block is described. The cylinder tubes of the cylinder block are connected with the cylinder block housing by a surrounding connection web which separates an upper cooling water jacket, which is open toward the cylinder head, and a lower oil jacket, which is open toward the crank case. The cylinder tubes can be molded out during the casting of the cylinder block or can be cast in as inserted cylinder liners.

Such known cylinder blocks have the disadvantage, however, that, after the assembly of the entire internal-combustion engine, as a result of the introduced forces, particularly from the screwed connection of the cylinder head, considerable cylinder tube deformations will occur. These cylinder tube deformations may occur in the form of oval shapes or in the form of clover-leaf-shaped contractions. These deformations are most pronounced in the area of the upper end of the cylinder tubes facing the cylinder head and approach their minimum in the area of the surrounding connection web. On the opposite side, these deformations continue in the opposite direction toward the lower free end of the cylinder tube. Such cylinder tube deformations are described with regard to a closed-deck construction cylinder block in EP 0 628 716 A1.

In addition, EP 0 137 328 A2 describes a cylinder block of the open-deck construction having the connection web constructed at the lower end of the cylinder tubes facing the crank case. An oil jacket is not provided. Ribs are provided in the cooling water jacket of this cylinder block and extend along almost the total height of the water jacket and are used for influencing the cooling water flow.

An object of the present invention is to provide an improved cylinder block of the open-deck construction such that, in the assembled braced condition of the cylinder block or of the cylinder tubes, the cylinder tube distortions are reduced or minimized.

According to the present invention, this object has been achieved by providing that either the surrounding connection web in the area of the water jacket is provided with ribs between the cylinder tube and the cylinder block housing whose height $h_1$ is lower than 0.5 $H_1$ (height of the cooling water jacket) or the surrounding connection web in the area of the oil jacket is provided with ribs between the cylinder tube and the cylinder block housing whose height $h_2$ is lower than 0.5 $H_2$ (height of the oil jacket).

By arranging ribs on the connection web to extend between the cylinder tube and the cylinder block housing, the stiffness of the cylinder tube can be increased at relatively low expenditures and with a very low weight increase. Thereby, in the braced condition, the cylinder tube distortions are considerably minimized. Without higher expenditures with respect to the manufacturing technique, such ribs can be produced during the casting production of the cylinder block.

The arrangement of the ribs on the connection web and their relatively low height in comparison to the water jacket ensures an undisturbed cooling water flow in the area of the highest temperature-caused stress, particularly in the upper area of the cooling water jacket adjoining the cylinder head.

A particularly good tension course within the cylinder block and a clear reduction of the cylinder tube distortions occurs if the ribs on the connection web are constructed to be at least partially triangular and, starting from the cylinder tube, rise toward the cylinder block housing. The linking length to the cylinder tube can thereby be minimized to considerably influence the extent of the cylinder tube distortions. Because of the triangular rib construction, component distortions are introduced into the cylinder tube to a significantly lower degree.

With the arrangement of ribs in the water jacket, in addition, the influence on the cooling water flow is reduced in a particularly advantageous manner. Cylinder tube distortions are avoided in a particularly effective manner in that ribs are arranged on the connection web in the oil jacket as well as in the water jacket. The ribs can also be advantageously situated opposite one another in the cooling water jacket and in the oil jacket.

A linking of the cylinder tubes which is improved in this manner in the case of cylinder blocks of the open-deck construction, is particularly suitable for individually standing cylinder tubes which are not connected with one another.

In order to permit a transverse flow of the cooling water in the area of the water jacket in such cylinder blocks in a particularly advantageous manner, ribs can be arranged between two adjoining cylinder tubes respectively. These ribs extend perpendicularly to the longitudinal course of the cylinder block in the cooling water jacket and connect the two opposite cylinder block housing sides. In a particularly advantageous manner, these ribs can be pulled up to approximately the upper side of the cylinder block facing the cylinder head. This results in a further stiffening of the cylinder block, while optimizing, the transverse flow around the respective cylinder tube and facilitating an adjustment of a defined cooling water flow. Nevertheless, with such additional ribs, a transfer of the cooling water from the respective cooling jacket section of one cylinder tube to the other can take place by way of the remaining free space on the top side of the cylinder block.

A further stiffening of the entire cylinder block with a simultaneous reduction of the cylinder tube distortions is achieved if two adjacent cylinder tubes respectively are connected with one another by way of longer ribs in the oil jacket. A particularly favorable tension course is obtained if these additional longer ribs have a curved construction.

The cylinder tube distortions in the braced condition are minimized in a particularly advantageous manner if the ribs are arranged on the connection web in the area of the screwed connections of the cylinder head. A radial rib course is particularly favorable. Particularly when the ribs follow the course of a connection line between the axis of the screwed connection of the cylinder head and the cylinder head axis, particularly advantageously, a clear reduction of the cylinder head distortions will be ensured.

BRIEF DESCRIPTION OF THE DRAWINGS

Other objects, advantages and novel features of the present invention will become apparent from the following detailed description of the invention when considered in conjunction with the accompanying drawings wherein.

DETAILED DESCRIPTION OF THE DRAWINGS

Figure 1:
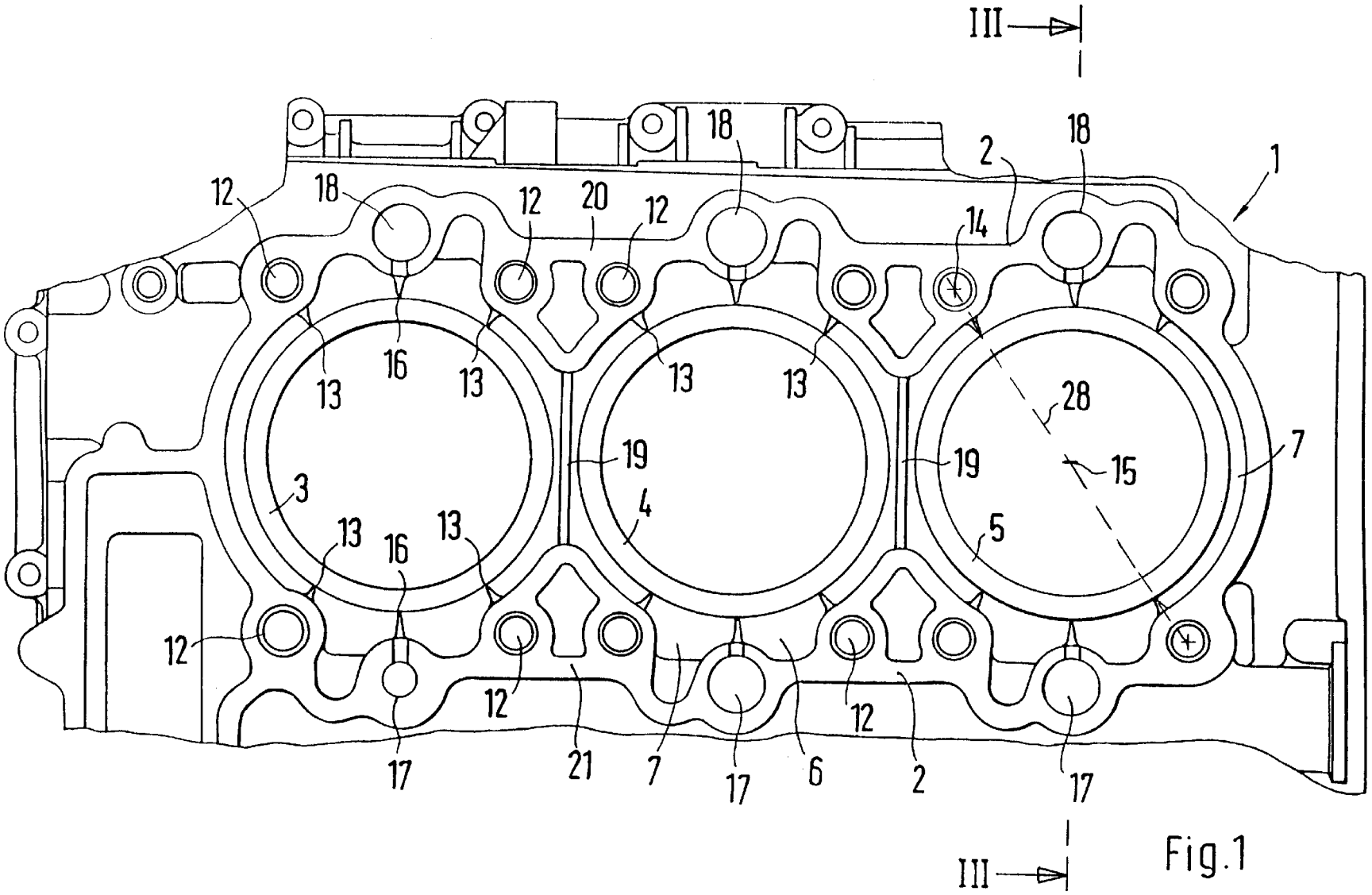
FIG. 1 is a partial plan view of the cylinder block in accordance with the present invention and is open toward the top in the direction of the cylinder head.
Figure 2:
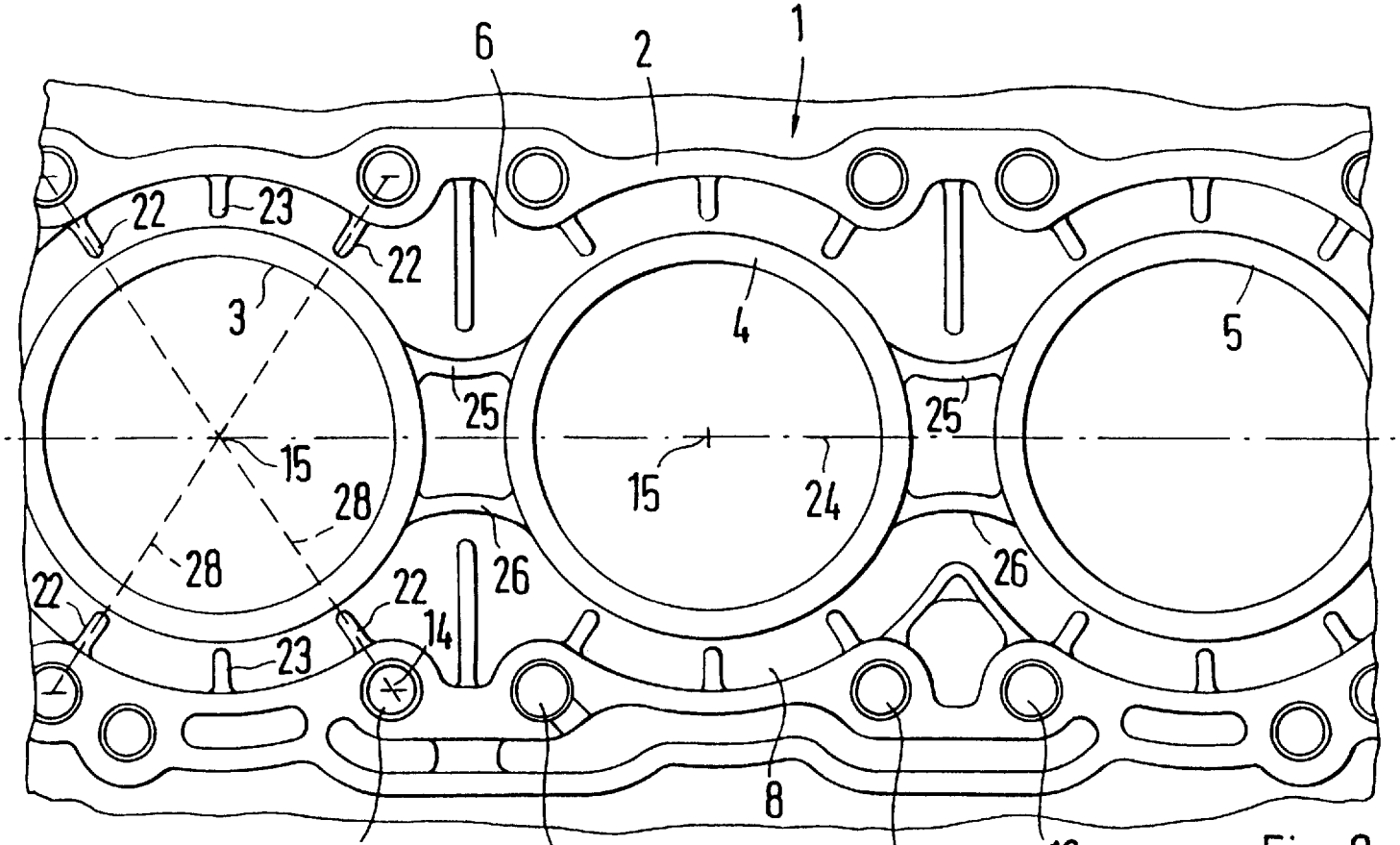
FIG. 2 is a partial plan view of the bottom side of the open cylinder block of FIG. 1.
Figure 3:
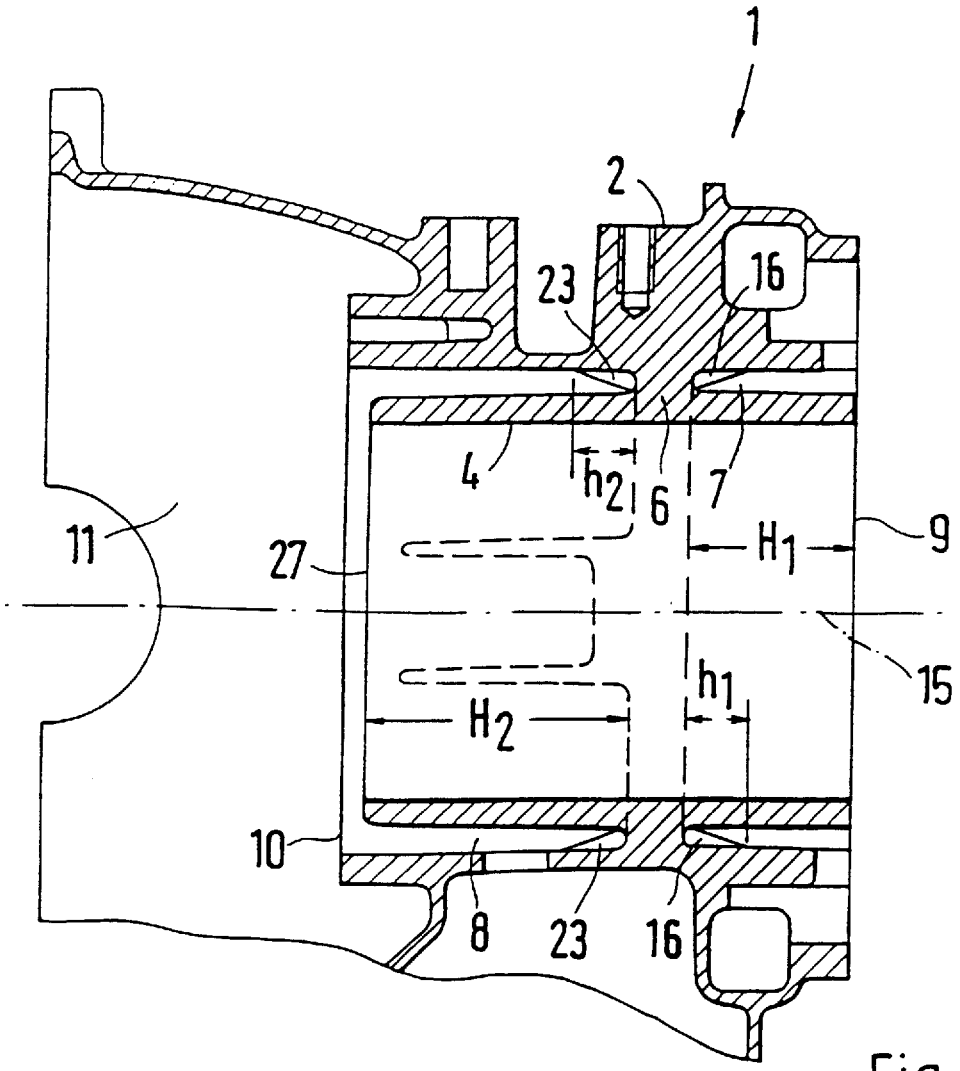
FIG. 3 is a sectional view of the cylinder block along line III—III of FIG. 1.

The embodiment of the cylinder block designated generally by numeral 1 in FIGS. 1 to 3 has a cylinder block housing 2 in which several cylinder tubes 3, 4, 5 are arranged as individual tubes, i.e., they are not cohesive or connected. They cylinder tubes 3, 4, 5 are connected with the cylinder block housing 2 by way of a cohesive connection web 6. The connection web 6, which comprises all cylinder tubes 3, 4, 5, divides the space between the cylinder tubes and the cylinder block housing into an upper cooling water jacket 7 (FIG. 1) and a lower oil jacket 8 (FIG. 2). The cooling water jacket 7 reaches in an approximately ring-shaped manner around each of the cylinder tubes 3, 4, 5 and is open toward the upper side 9 of the cylinder block (FIG. 3); i.e., toward a conventional cylinder head. Similarly, the oil jacket 8 reaches around the cylinder tubes 3, 4, 5 below the connection web 6 and is open toward the lower side 10 of the cylinder block (FIG. 3); i.e., toward the crank case 11.

In this illustrated embodiment, the cylinder block housing 2 is penetrated per cylinder tube 3, 4, 5 by four screwed cylinder head connections 12 which fasten the cylinder head on the upper side 9 of the cylinder block and reach into a crankshaft bearing frame (not shown) fastened on the lower side 10 of the cylinder block.

In the cooling water jacket 7, four ribs 13 are constructed per cylinder tube 3, 4, 5 and are connected with the connection web 6. These ribs 13 have an approximately triangular shape and rise, starting from a transition between the connection web 6 and the respective cylinder tube 3, 4, 5, toward the cylinder block housing 2. The four ribs 13 per cylinder tube 3, 4, 5 are arranged such that they extend in each case on a connection line 28 between the axis 14 of the respective adjoining screwed cylinder head connection 12 and the cylinder axis 15 of the respective cylinder tube. The height $h_1$ of the ribs 13 is clearly or substantially lower than the height $H_1$ of the cooling water jacket 7, amounting here to approximately one-third the height of the water jacket but should maximally reach into the center of the water jacket; that is, $h_1$ should be lower than $0.5\ H_1$.

In the cooling water jacket 7, two additional similarly shaped ribs 16 are arranged for each cylinder tube 3, 4, 5 and also extend approximately radially. These ribs 16 are arranged in the area of the cooling water feeding devices 17 and of the cooling water return devices 18 which are each connected with the cooling water jacket.

Between two adjacent cylinder tubes 3, 4 and 4, 5, additional ribs 19 start from the connection web 6 and are connected with two opposite wall sections 20, 21 of the cylinder block housing 2. These additional ribs 19 extend approximately perpendicularly to the longitudinal direction or course of the cylinder block and divide the cooling water jacket 7 into cylinder-tube-related individual sections. The ribs 19 extend from the connection web 6 and to close to the upper side 9 of the cylinder block without reaching the latter. A cooling water exchange between individual sections of the cooling water jacket is provided by way of the remaining space for operation of the internal-combustion engine. The ribs 19 provide an increased stiffness of the cylinder block housing 2 and permit a cylinder-tube-related transverse flow cooling within the cooling water jacket.

In the oil jacket 8, four ribs 22 are also arranged per cylinder tube 3, 4, 5 and extend in a triangular shape or pattern starting from the transition between the cylinder tube 3, 4, 5 and the connection web 6, to the cylinder block housing 2. These ribs 22 are also arranged in the area of the screwed cylinder head connections 12 and extend radially toward the respective cylinder tube axis 15. The ribs 22 in the oil jacket 8 are situated on the connection line 28 between the axis 15 of the respective cylinder tube and the corresponding axis 14 of the screwed cylinder head connection 12. Two additional ribs 23 are arranged in the oil jacket on the side opposite the ribs 16 in the cooling water jacket. These additional ribs 23 extend also approximately radially and here are approximately perpendicular with respect to the longitudinal course or direction of the cylinder block (connection line 24 between the cylinder tube axes 15). The height $h_2$ of the ribs 22, 23 in the oil jacket 8 is clearly or substantially lower than the height $H_2$ of the oil jacket. The height $h_2$ of the ribs 22 and 23 is approximately one-fourth of the height $H_2$ of the oil jacket.

Also, two additional curved ribs 25 and 26 are arranged in the oil jacket 8 which each connect two adjoining cylinder tubes 3, 4 and 4, 5 with one another. These additional curved ribs 25, 26 each start out from the connection web 6 and reach into the proximity of the lower ends 27 of the cylinder tubes 3, 4, 5. In the top view, these additional curved ribs 25, 26 describe a curve whose interior side faces the respective adjoining wall of the cylinder block housing 2.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Cylinder block of an internal-combustion engine of open-deck construction, comprising at least one cylinder tube, a cylinder block housing, a cooling water jacket and an oil jacket operatively arranged between the cylinder tube and the cylinder block housing and having a surrounding connection web between the cylinder tube and the cylinder block housing to separate the oil jacket and the cooling water jacket, wherein the surrounding connection web in an area of the water jacket includes ribs between the cylinder tube and the cylinder block housing having a height less than half a height of the cooling water jacket.

2. Cylinder block of an internal-combustion engine of open-deck construction, comprising at least one cylinder tube, a cylinder block housing, a cooling water jacket and an oil jacket operatively arranged between the cylinder tube and the cylinder block housing and having a surrounding connection web between the cylinder tube and the cylinder block housing to separate the oil jacket and the cooling water jacket, wherein the surrounding connection web in an area of the oil jacket includes ribs between the cylinder tube and the cylinder block housing having a height less than half a height of the oil jacket.

3. The cylinder block according to claim 1, wherein the ribs have at least a partially triangular configuration and, from the cylinder tube, rise toward the cylinder block housing.

4. The cylinder block according to claim 2, wherein the ribs have at least a partially triangular configuration and, from the cylinder tube, rise toward the cylinder block housing.

5. The cylinder block according to claim 1, wherein the ribs are arranged in the cooling water jacket and in the oil jacket.

6. The cylinder block according to claim 2, wherein the ribs are arranged in the cooling water jacket and in the oil jacket.

7. The cylinder block according to claim 5, wherein the ribs are arranged in an opposite manner in the cooling water jacket and in the oil jacket.

8. The cylinder block according to claim 6, wherein the ribs are arranged in an opposite manner in the cooling water jacket and in the oil jacket.

9. The cylinder block according to claim 1, wherein the ribs are arranged at least partially in an area of screwed cylinder head connections.

10. The cylinder block according to claim 2, wherein the ribs are arranged at least partially in an area of screwed cylinder head connections.

11. The cylinder block according to claim 1, wherein the ribs extend at least approximately radially relative to a cylinder tube axis.

12. The cylinder block according to claim 2, wherein the ribs extend at least approximately radially relative to a cylinder tube axis.

13. The cylinder block according to claim 9, wherein a longitudinal course of the ribs follows a connection line between an axis of the respective screwed cylinder head connection and a cylinder tube axis.

14. The cylinder block according to claim 10, wherein a longitudinal course of the ribs follows a connection line between an axis of the respective screwed cylinder head connection and a cylinder tube axis.

15. The cylinder block according to claim 11, wherein a longitudinal course of the ribs follows a connection line between an axis of a respective screwed cylinder head connection and the cylinder tube axis.

16. The cylinder block according to claim 12, wherein a longitudinal course of the ribs follows a connection line between an axis of a respective screwed cylinder head connection and a cylinder tube axis.

17. The cylinder block according to claim 1, wherein at least two cylinder tubes are formed in the cylinder block, and additional curved ribs extend between two adjacent cylinder tubes and are connected with the cylinder tubes and the connection web.

18. The cylinder block according to claim 2, wherein at least two cylinder tubes are formed in the cylinder block, and additional curved ribs extend between two adjacent cylinder tubes and are connected with the cylinder tubes and the connection web.

19. The cylinder block according to claim 17, wherein a curvature of the additional ribs extends in opposite directions to each other.

20. The cylinder block according to claim 18, wherein a curvature of the additional ribs extends in opposite directions to each other.

21. The cylinder block according to claim 1, wherein at least two cylinder tubes are formed in the cylinder block, and additional longer ribs are arranged in the water jacket between two adjacent cylinder tubes and extend at a right angle with respect to the longitudinal course of the cylinder block, are connected with the connection web and extend from the cylinder block housing.

22. The cylinder block according to claim 2, wherein at least two cylinder tubes are formed in the cylinder block, and additional longer ribs are arranged in the water jacket between two adjacent cylinder tubes and extend at a right angle with respect to the longitudinal course of the cylinder block, are connected with the connection web and extend from the cylinder block housing.

* * * * *